US007958597B2

(12) United States Patent
Frantzen et al.

(10) Patent No.: US 7,958,597 B2
(45) Date of Patent: Jun. 14, 2011

(54) HANDHELD VACUUM CLEANER

(75) Inventors: Thommy Frantzen, Sollentuna (SE); Henrik Holm, Lidingö (SE); Roger Karlsson, Stockholm (SE)

(73) Assignee: AB Electrolux, Stockholm (SE)

( * ) Notice: Subject to any disclaimer, the term of this patent is extended or adjusted under 35 U.S.C. 154(b) by 499 days.

(21) Appl. No.: 12/294,395

(22) PCT Filed: Mar. 15, 2007

(86) PCT No.: PCT/SE2007/000259

§ 371 (c)(1),
(2), (4) Date: Sep. 24, 2008

(87) PCT Pub. No.: WO2007/111551

PCT Pub. Date: Oct. 4, 2007

(65) Prior Publication Data

US 2009/0165239 A1 Jul. 2, 2009

(30) Foreign Application Priority Data

Mar. 24, 2006 (SE) ..... 0600668

(51) Int. Cl.
*A47L 5/24* (2006.01)

(52) U.S. Cl. ..... 15/344; 15/347; 15/328

(58) Field of Classification Search ..... 15/344, 15/347, 352, 328, 329
See application file for complete search history.

(56) References Cited

U.S. PATENT DOCUMENTS

| | | | |
|---|---|---|---|
| 2,707,792 | A | 5/1955 | Waller |
| 2,863,524 | A | 12/1958 | Buda |
| 3,199,138 | A | 8/1965 | Nordeen |
| 3,621,640 | A | 11/1971 | Ohno et al. |
| 3,653,189 | A | 4/1972 | Miyake et al. |
| 3,906,219 | A | 9/1975 | Stauffer |
| 4,213,224 | A | 7/1980 | Miller |
| 4,276,070 | A | 6/1981 | Hug |
| 4,376,322 | A | 3/1983 | Lockhart et al. |
| 4,421,964 | A | 12/1983 | Buchtel |
| 4,467,493 | A | 8/1984 | Buchtel |
| 4,541,142 | A | 9/1985 | Pudwill |
| 4,545,089 | A | 10/1985 | Oxel |
| 4,573,234 | A | 3/1986 | Kochte et al. |

(Continued)

FOREIGN PATENT DOCUMENTS

CA 2087056 7/1994

(Continued)

OTHER PUBLICATIONS

"The Boss, Heavy Duty Rechargeable Vacuum, Model 98," Eureka brochure dated 1998, 2 pages.

(Continued)

*Primary Examiner* — Dung Van Nguyen

(74) *Attorney, Agent, or Firm* — Hunton & Williams

(57) ABSTRACT

A handheld vacuum cleaner having a housing with an electric motor, a fan driven by the motor, a debris emptying hole for removal of debris from a debris collecting compartment inside the vacuum cleaner, a lid pivotally hinged about a pivot axis and adapted to allow closing and opening of the debris emptying hole, a nozzle defining a nozzle opening in a forward end of the vacuum cleaner through which an air stream may be drawn for collecting debris, and at least two wheels, which are positioned adjacent the nozzle opening and are rotatable about a common rotation axis. The pivot axis for the lid and the rotation axis for the wheels are located on a common axis.

12 Claims, 3 Drawing Sheets

U.S. PATENT DOCUMENTS

| | | | |
|---|---|---|---|
| 4,573,237 | A | 3/1986 | Kochte et al. |
| 4,621,390 | A | 11/1986 | Hampton et al. |
| 4,635,315 | A | 1/1987 | Kozak |
| 4,665,582 | A | 5/1987 | Richmond et al. |
| 4,670,701 | A | 6/1987 | Sako et al. |
| 4,704,765 | A | 11/1987 | Ataka |
| 4,748,713 | A | 6/1988 | Sepke et al. |
| 4,766,638 | A | 8/1988 | McDowell |
| 4,787,923 | A | 11/1988 | Fleigle et al. |
| 4,804,481 | A | 2/1989 | Lennartz |
| D300,214 | S | 3/1989 | Adams |
| 4,821,366 | A | 4/1989 | Levine |
| 4,831,685 | A | 5/1989 | Bosyj et al. |
| 4,841,594 | A | 6/1989 | Elson et al. |
| D304,104 | S | 10/1989 | Busalt et al. |
| 4,876,763 | A | 10/1989 | Cho et al. |
| 4,894,882 | A | 1/1990 | Toya |
| 4,899,418 | A | 2/1990 | Steiner et al. |
| D307,657 | S | 5/1990 | Li |
| 4,920,606 | A | 5/1990 | Gerke, Jr. et al. |
| 4,920,608 | A | 5/1990 | Hult et al. |
| 4,928,346 | A | 5/1990 | Elson et al. |
| 4,934,020 | A | 6/1990 | Jackson |
| 4,942,641 | A | 7/1990 | Gerke, Jr. et al. |
| 4,947,514 | A | 8/1990 | Gerke, Jr. et al. |
| 4,967,443 | A | 11/1990 | Krasznai et al. |
| 4,993,106 | A | 2/1991 | Hult et al. |
| 5,005,252 | A | 4/1991 | Steiner et al. |
| 5,020,187 | A | 6/1991 | Kosten et al. |
| 5,025,529 | A | 6/1991 | Hult et al. |
| 5,035,024 | A | 7/1991 | Steiner et al. |
| 5,065,473 | A | 11/1991 | Krasznai et al. |
| 5,107,567 | A | 4/1992 | Ferrari et al. |
| 5,309,600 | A | 5/1994 | Weaver et al. |
| 5,322,534 | A | 6/1994 | Kaiser |
| 5,342,433 | A | 8/1994 | Avondoglio |
| D352,807 | S | 11/1994 | Sanderud |
| D364,013 | S | 11/1995 | Klingspor et al. |
| 5,524,321 | A | 6/1996 | Weaver et al. |
| 5,561,885 | A | 10/1996 | Zahuranec et al. |
| 5,584,095 | A | 12/1996 | Redding et al. |
| 5,603,740 | A | 2/1997 | Roy |
| 5,661,885 | A | 9/1997 | Donato |
| 5,715,566 | A | 2/1998 | Weaver et al. |
| 5,733,351 | A | 3/1998 | Hult et al. |
| 5,819,364 | A | 10/1998 | Sham |
| 5,869,947 | A | 2/1999 | Zahuranec et al. |
| 5,966,774 | A | 10/1999 | Bone et al. |
| 6,029,313 | A | 2/2000 | O'Dea et al. |
| 6,094,775 | A | 8/2000 | Behmer |
| 6,108,864 | A | 8/2000 | Thomas et al. |
| 6,122,796 | A | 9/2000 | Downham et al. |
| 6,125,498 | A | 10/2000 | Roberts et al. |
| 6,131,239 | A | 10/2000 | White |
| 6,146,434 | A | 11/2000 | Scalfani et al. |
| 6,189,178 | B1 | 2/2001 | Roberts |
| 6,311,366 | B1 | 11/2001 | Sepke et al. |
| 6,324,714 | B1 | 12/2001 | Walz et al. |
| 6,428,589 | B1 | 8/2002 | Bair et al. |
| 6,434,785 | B1 | 8/2002 | Vandenbelt et al. |
| 6,839,934 | B2 | 1/2003 | Houghton et al. |
| 6,546,592 | B1 | 4/2003 | Cockburn et al. |
| 6,571,421 | B1 | 6/2003 | Sham et al. |
| 6,775,882 | B2 | 7/2003 | Murphy et al. |
| 6,625,845 | B2 | 9/2003 | Matsumoto et al. |
| 6,647,587 | B1 | 11/2003 | Ohara et al. |
| 6,658,693 | B1 | 12/2003 | Reed, Jr. |
| 6,736,873 | B2 | 5/2004 | Conrad et al. |
| 6,766,558 | B1 | 7/2004 | Matsumoto et al. |
| 6,811,584 | B2 | 11/2004 | Oh |
| 6,824,580 | B2 | 11/2004 | Oh |
| 6,857,165 | B2 | 2/2005 | Oh |
| 6,948,211 | B2 | 9/2005 | Stephens et al. |
| 6,964,082 | B2 | 11/2005 | Hsu |
| 6,968,596 | B2 | 11/2005 | Oh et al. |
| 7,377,007 | B2 | 5/2008 | Best |
| 7,386,916 | B2 | 6/2008 | Bone |
| 7,404,838 | B1 | 7/2008 | Pathak |
| 7,412,749 | B2 | 8/2008 | Thomas et al. |
| 2002/0042969 | A1 | 4/2002 | Nagai et al. |
| 2002/0073504 | A1 | 6/2002 | Hall et al. |
| 2002/0189048 | A1 | 12/2002 | Maruyama et al. |
| 2003/0019073 | A1 | 1/2003 | Oh |
| 2003/0159235 | A1 | 8/2003 | Oh |
| 2003/0163887 | A1 | 9/2003 | Inoue |
| 2003/0208879 | A1 | 11/2003 | Oh et al. |
| 2003/0213091 | A1 | 11/2003 | Oh et al. |
| 2004/0098957 | A1 | 5/2004 | Yoo et al. |
| 2004/0103496 | A1 | 6/2004 | Worwag |
| 2004/0134022 | A1 | 7/2004 | Murphy et al. |
| 2004/0177471 | A1 | 9/2004 | Jung et al. |
| 2004/0187253 | A1 | 9/2004 | Jin et al. |
| 2004/0200029 | A1 | 10/2004 | Jin et al. |
| 2004/0216263 | A1 | 11/2004 | Best |
| 2004/0261212 | A1 | 12/2004 | Park et al. |
| 2004/0261213 | A1 | 12/2004 | Park et al. |
| 2005/0005390 | A1 | 1/2005 | Lee et al. |
| 2005/0005391 | A1 | 1/2005 | Park |
| 2005/0081321 | A1 | 4/2005 | Milligan et al. |
| 2005/0125939 | A1 | 6/2005 | Hansen et al. |
| 2005/0125940 | A1 | 6/2005 | McDowell |
| 2005/0183406 | A1 | 8/2005 | Coburn |
| 2006/0064828 | A1 | 3/2006 | Stein et al. |
| 2006/0156508 | A1 | 7/2006 | Khalil |
| 2007/0226946 | A1 | 11/2007 | Miefalk et al. |

FOREIGN PATENT DOCUMENTS

| | | | |
|---|---|---|---|
| CN | 1272873.X | | 1/2003 |
| DE | G 79 29 844.5 | | 3/1981 |
| DE | 32 28 491 | A1 | 2/1984 |
| DE | 33 09 162 | A1 | 9/1984 |
| DE | 33 25 336 | | 1/1985 |
| DE | 8623004 | | 10/1986 |
| DE | 37 43 083 | A1 | 6/1989 |
| DE | G 90 10 066.2 | | 10/1991 |
| DE | G 91 14 371.3 | | 4/1992 |
| DE | 4038262 | | 6/1992 |
| DE | 19630286 | | 1/1998 |
| DE | 10110581 | | 11/2001 |
| DE | 10124216 | | 1/2002 |
| EP | 0 170 720 | | 2/1986 |
| EP | 0 215 619 | A2 | 3/1987 |
| EP | 0 827 710 | A2 | 3/1998 |
| EP | 0 853 917 | | 7/1998 |
| EP | 0914795 | A2 | 12/1999 |
| EP | 1 070 478 | | 1/2001 |
| EP | 1 224 898 | | 7/2002 |
| EP | 1 279 362 | | 1/2003 |
| FR | 2603181 | | 6/1987 |
| GB | 857580 | | 12/1960 |
| GB | 990065 | | 4/1965 |
| GB | 1201841 | | 8/1970 |
| GB | 2035787 | A | 6/1980 |
| GB | 2137896 | | 10/1984 |
| GB | 2155314 | | 9/1985 |
| GB | 2189382 | A | 10/1987 |
| GB | 2268875 | | 1/1994 |
| GB | 2291790 | | 7/1994 |
| GB | 2 349 105 | | 10/2000 |
| GB | 2 372 434 | | 8/2002 |
| GB | 2398486 | A | 8/2004 |
| GB | 2413942 | | 11/2005 |
| JP | 54-100149 | | 8/1979 |
| JP | 3-267032 | | 11/1991 |
| JP | 4364822 | | 12/1992 |
| JP | 52-73557 | | 10/1998 |
| JP | 2000-070198 | | 3/2000 |
| JP | 2001-095735 | | 4/2001 |
| JP | 2001353110 | | 12/2001 |
| JP | 2002 085297 | A | 3/2002 |
| JP | 2002 136456 | A | 5/2002 |
| JP | 2003 275154 | A | 9/2003 |
| SE | 514314 | C2 | 3/1998 |
| SE | 510283 | C2 | 10/1998 |
| WO | WO 97/20492 | | 6/1997 |

| | | |
|---|---|---|
| WO | WO 03/009736 | 2/2003 |
| WO | WO 2004/069021 | 8/2004 |
| WO | WO 2005/111084 | 11/2005 |

OTHER PUBLICATIONS

Black & white printouts of http://www.igia.com/prodetail.cfm?ID=AT7290 "IGIA Vac Blue" (3 pages).

Black & white printouts of http://www.igia.com/prodetail.cfm?ID=AT7691 "Wind Storm Wet/Dry Vacuum" (1 page).

Black & white printouts of http://www.igia.com/prodetail.cfm?ID=AT7739 "Wind Storm Vacuum" (3 pages).

Black & white printouts of http://www.sewserg.com/products/abp02698.html Miele S147 Little Giant Plus Vacuum Cleaner with Free 5 YR Extended Warranty/Replacement (3 pages).

Black & white printouts of http://www.sewserg.com/products/abp09802-0775.html "Wind Storm AT7813 3in1 Upright, Stick & Hand Held Bagless Vacuum Cleaner Windstorm, 4 Attachments, Fold Down Handle for Storage, Weighs under 8 Pounds" (3 pages).

Black & white printouts of http://www.zweita.net/ "Product Info" (3 pages).

Fakir product pages catalogue, 2002 (5 pages).

HANDHELD VACUUM CLEANER

The invention relates to a handheld vacuum cleaner of the kind having, for example, a housing comprising an electric motor and a fan driven by the motor, a debris emptying hole for removal of debris from a debris collecting compartment inside the vacuum cleaner, a lid being pivotally hinged about a pivot axis and adapted to allow closing and opening of the debris emptying hole, a nozzle defining a nozzle opening in a forward end of the vacuum cleaner through which an air stream may be drawn for collecting of debris and dust, and at least two wheels which are positioned adjacent the nozzle opening and being rotatable about a common rotation axis.

BACKGROUND OF THE INVENTION

Vacuum cleaners of the above related kind are available in many different embodiments. A common feature is that they should be as compact and lightweight as possible to easily be carried around for cleaning in desirable locations. The compact design will of course restrict the possibilities for positioning of components in the vacuum cleaner, such as, for example, the debris emptying hole and the lid closing it, and it can sometimes be hard to find an acceptable hinge position for the debris emptying lid within existing space. As with most products it is also an advantage if the vacuum cleaner can be manufactured in an as simple and cost reducing way as possible.

A handheld vacuum cleaner of this kind typically is not provided with a suction hose as conventional vacuum cleaners, which normally are positioned on the floor during use. Instead a nozzle opening is formed directly in a forward end of the body structure or housing through which air and debris are drawn into the vacuum cleaner. For facilitating cleaning and to prevent scratching of the surface being cleaned, these vacuum cleaners can be provided with wheels or castors in the vicinity of the nozzle opening, such that the vacuum cleaner can be rolled over the surface to be cleaned, while keeping the nozzle opening spaced a small distance from the surface for generating of a fast flowing air stream to draw the debris and dust into the nozzle opening. Accordingly, the wheels function also as spacers for maintaining at least a portion of the rim of the nozzle opening a desired distance from the surface being cleaned. In most cases it is sufficient if the vacuum cleaner is provided with two wheels, which preferably are rotatable about a common rotation axis. However, it is possible to arrange three or more wheels, which are rotatable about two or more rotation axes to define a plane for the nozzle rim to be moved in at a fixed distance from the surface to be cleaned.

SUMMARY OF THE INVENTION

In one aspect, the present invention addresses handheld vacuum cleaners, such as those described above, and may reduce the costs for components and assembling of such vacuum cleaners and enables a more compact design of the vacuum cleaner. These objects may be achieved by an embodiment of the invention in which a vacuum cleaner is provided having a debris emptying lid and inlet opening wheels, and in which the pivot axis for the lid and the rotation axis for the wheels are along the same geometric axis (that is, they are provided along a common axis). In this way only one axis arrangement is necessary for pivotally mounting the lid and rotatably mounting the wheels—that is, a single pivot/rotation axis is provided, as opposed to a separate pivot axis for the lid and a rotation axis for the wheels. Such an embodiment may be both space saving and cost saving in terms of material/components and assembly time.

It will be understood that by the term axis, as used herein, refers to the geometrical axis for the rotating and pivoting motion of the wheels and the lid. This geometric axis may, in practice, be realized in many different ways. In a hereinafter described and illustrated exemplary embodiment of the invention, the axis is realized as two short shaft pieces projecting in opposite directions from the housing of the vacuum cleaner. On each shaft piece is positioned one wheel and one mounting means for the lid. This provides a simple and cost effective way to realize the axis. It will be understood, however, that the axis could be formed in many other different ways and still remain within the scope of the invention. For example, the axis may be provided as: a single elongated shaft extending through some or all of the nozzle portion of the vacuum cleaner and upon which the wheels and lid are mounted; shaft projections provided on the wheels and/or the lid, which during mounting are inserted through holes in the other of the wheels or the lid and into holes in the housing; or, projections from the housing, preferably formed of the same material as and simultaneously with the housing (as opposed to separate shafts that are later inserted into the housing). The vacuum cleaner may also comprise additional wheels, which may be rotatable around the same axis as the lid an wheels, or around one or more axes different from the lid/wheel axis.

In one aspect of the invention, the wheels may be mounted innermost on each shaft piece, and the lid may be mounted with its pivotal mounting means outside of the wheels. In such a case, the lid may be somewhat unshaped and arching over the nozzle portion of the housing on the outside of the wheels. In this way the lid may cover the major part of the wheels, which may be desirable for aesthetically reasons. In this aspect, the lid may form part of a rim that defines the nozzle opening, and opening of the lid may be performed by pivoting the lid forward/upward towards the nozzle opening. The housing and/or the lid may have a stop to restrict the pivotal motion of the lid.

In the illustrated exemplary embodiment of the invention, the housing has a mounting wall defining a space located between the mounting wall and the remainder of the housing. A wheel is positioned in the space, and a shaft piece is introduced through a hole in the mounting wall, through the wheel, and into a hole in the housing. Thus installed, the shaft piece protrudes outside the mounting wall for defining shaft end portions onto which the lid is pivotally mounted. In this way the shaft pieces are mounted to the housing at two separate positions on opposite sides of each wheel (i.e., in the mounting wall and the in hole) and, accordingly, the shaft pieces and the wheels are firmly mounted the body structure. Of course, also other ways of mounting the wheels and the lid could be used with other aspects of the present invention. For instance, if the shaft piece (or a single common elongated shaft upon which both wheels are mounted), is sufficient firmly attached in the housing, the mounting wall could be eliminated, and the displacement of the wheel along the shaft may be prevented solely by the lid.

In the illustrated exemplary embodiment of the invention, the lid is mounted to the shafts by blind holes formed on the inner surfaces of the lid (i.e., the surfaces facing the housing of the vacuum cleaner around which the lid wraps). Of course, other mounting means, such as a snap-in connection or a screw connection, may be used to attach the lid to the vacuum cleaner.

BRIEF DESCRIPTION OF THE DRAWINGS

An exemplary embodiment of the invention will now be described with reference to the associated drawings, in which.

DETAILED DESCRIPTION OF ONE EMBODIMENT OF THE INVENTION

Figure 1:
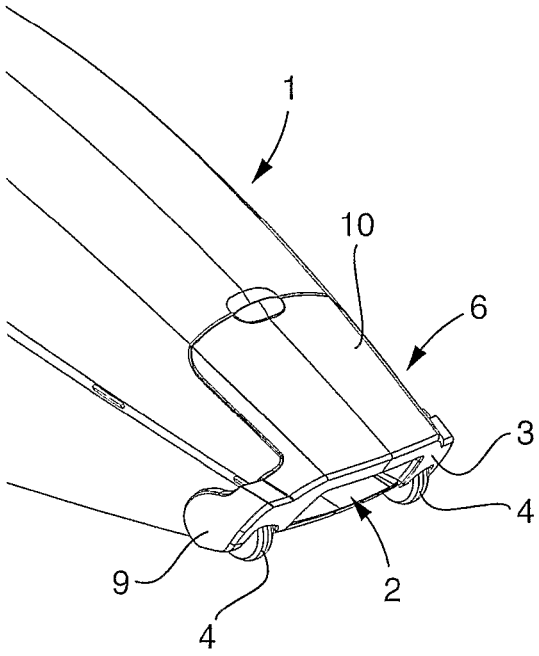
FIG. 1 is a perspective view of a front portion of a vacuum cleaner according to the invention.

In the drawings is shown, for purposes of simplicity, only a front portion of a body structure or housing 1 of a handheld vacuum cleaner according to one exemplary embodiment of the invention. Although not shown in the drawings, the housing may accommodate various vacuum cleaner features, such as a dust collecting compartment, an electric motor, a fan, and a power supply unit, which may include a battery to avoid the need to use an electrical supply cable when working with the vacuum cleaner. The outside of the vacuum cleaner may be provided with conventional vacuum cleaner features, such as a handle and electrical operator controls.

A handheld vacuum cleaner of the present invention may have a compact and lightweight design, so that it may be easily carried around for collecting dust and debris at various locations. Moreover, the handheld vacuum cleaner may not have a suction hose, as in some conventional vacuum cleaners. Instead the handheld vacuum cleaner has a nozzle opening 2, which is formed directly in a forward end of the housing 1. A rim 3 around the nozzle opening is located generally in a single common plane, but as shown for example in FIG. 2, the rim 3 need not be perfectly flat. Adjacent the nozzle opening are arranged two wheels 4, which are provided to facilitate use of the vacuum cleaner when cleaning debris from a surface 5. The wheels facilitate movement of the vacuum cleaner, and hold at least a portion of the nozzle rim 3 over the surface by a small distance, as is illustrated in FIG. 5, to reduce the risk that the rim 3 will scratch the surface.

Figure 2:
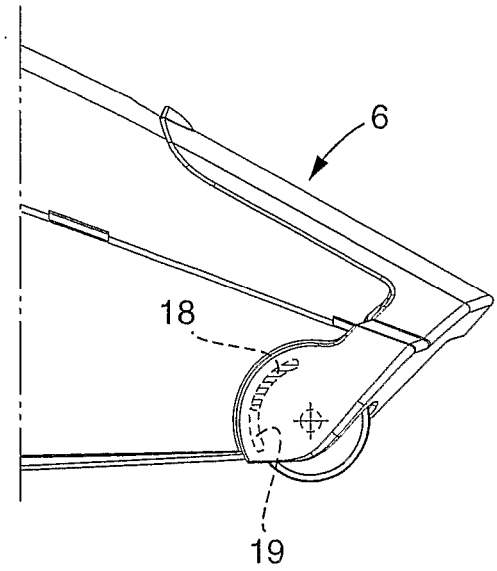
FIG. 2 is a side view of the vacuum cleaner in FIG. 1 with a debris emptying lid closed.
Figure 3:
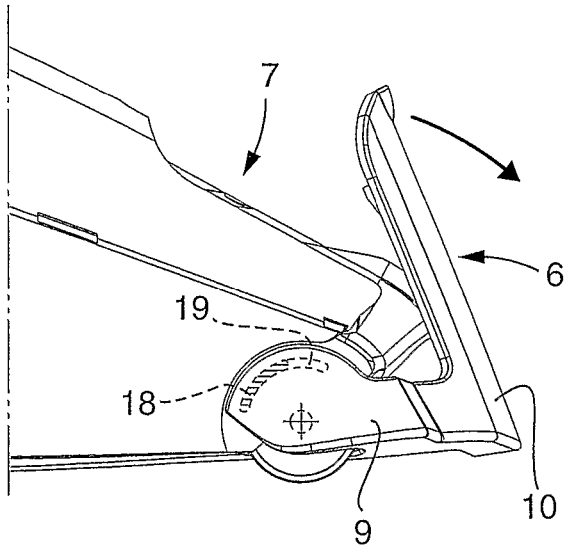
FIG. 3 is a side view according to FIG. 2 with the debris emptying lid open.
Figure 4:
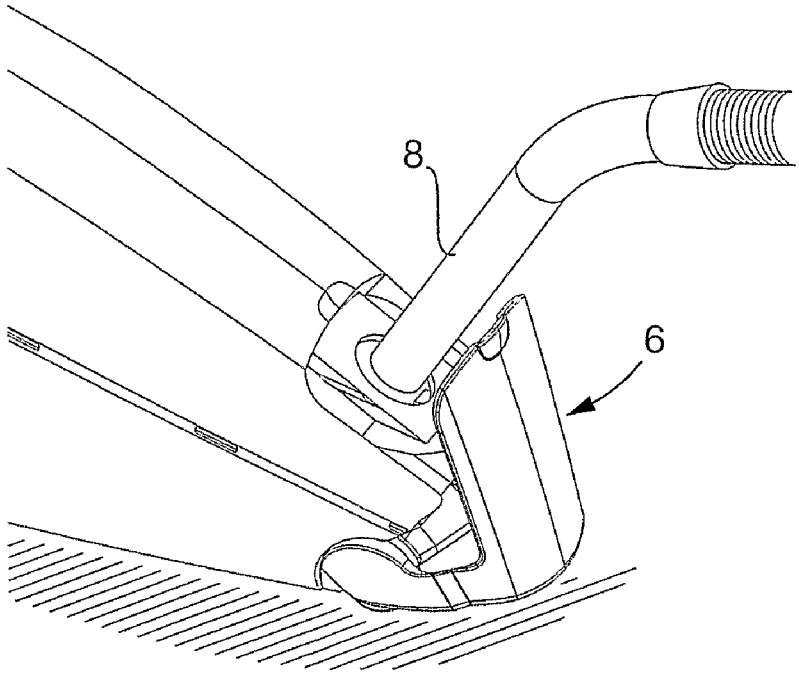
FIG. 4 is a perspective view of the vacuum cleaner during emptying of debris by means of a vacuum hose of a conventional vacuum cleaner.
Figure 5:
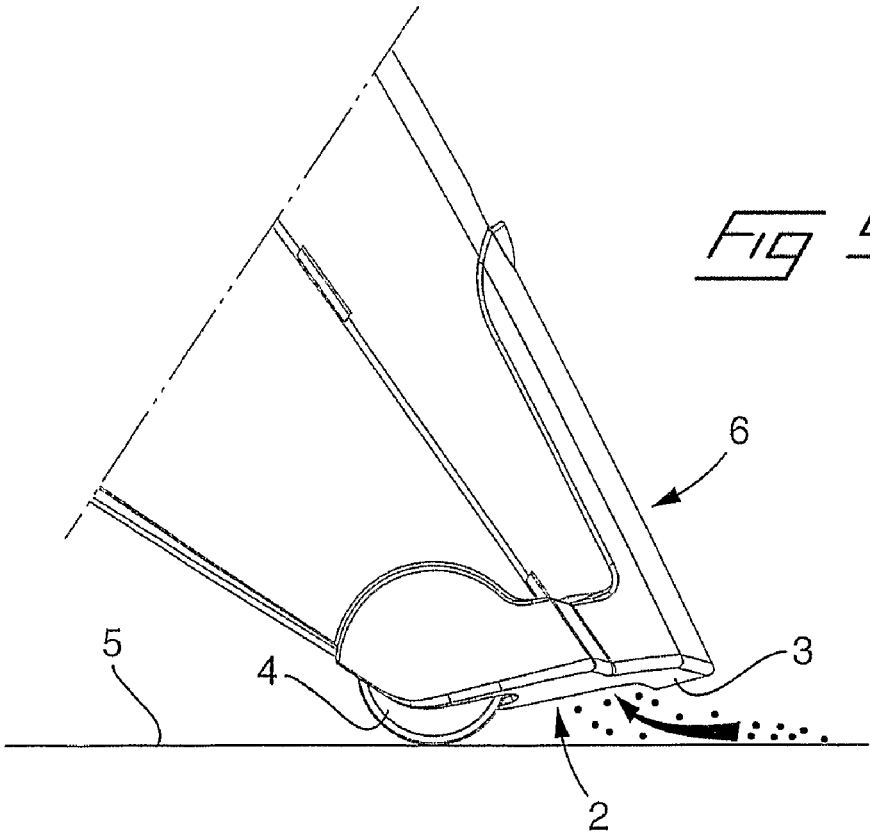
FIG. 5 is a side view of the vacuum cleaner during use for cleaning of a surface.

The exemplary embodiment of the vacuum cleaner also comprises a debris emptying lid 6, which is shown in a closed position in FIGS. 1, 2 and 5, and in an open position in FIGS. 3 and 4. The lid 6 covers a debris emptying hole 7, which provides access to an inner debris collecting compartment in which any debris drawn into the vacuum cleaner by an air stream through the nozzle opening 2 is collected. The debris emptying hole 7, in the illustrated embodiment, is of a kind adapted for cooperating with a vacuum cleaner hose 8 of a conventional vacuum cleaner to extract the debris accumulated therein, as is illustrated in FIG. 4. However, in an alternative embodiment, the debris emptying hole 7 also could be adapted for accommodating a dust bag, which captures the debris and is emptied or replaced when filled.

As is apparent from the drawings, the debris emptying lid 6 is arranged in a forward end of the vacuum cleaner, such that the lid forms part of the rim 3 defining the nozzle opening 2. More precisely, the lid 6 is U-formed, as seen from the nozzle opening, having two side portions 9 extending in a downward direction on both sides of the nozzle opening 2, and one upper portion 10 extending rearward from the nozzle opening and covering the debris emptying hole 7. The lid 6 is pivotally connected to the housing 1 in the lower portion of each side portion 9. In accordance with the illustrated exemplary embodiment of the invention, the pivoting axis of the lid 6 is combined with the rotation axis of the wheels 4.

Figure 6:
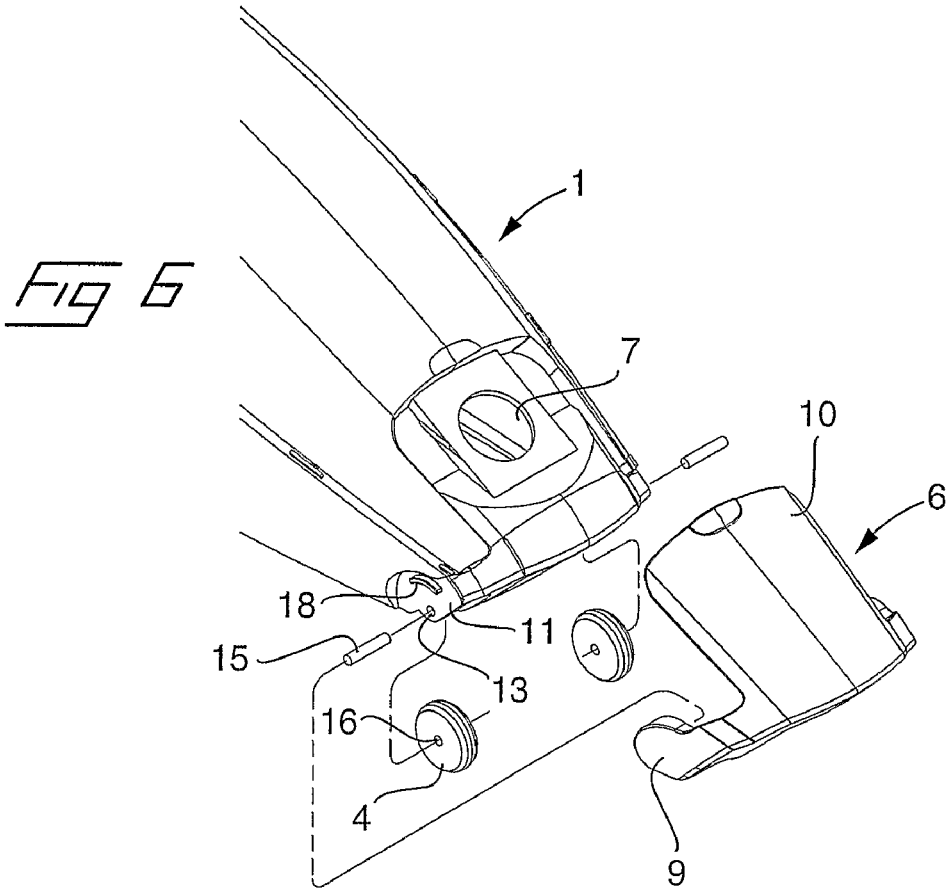
FIG. 6 is an exploded perspective view from above of the front portion of the vacuum cleaner.
Figure 7:
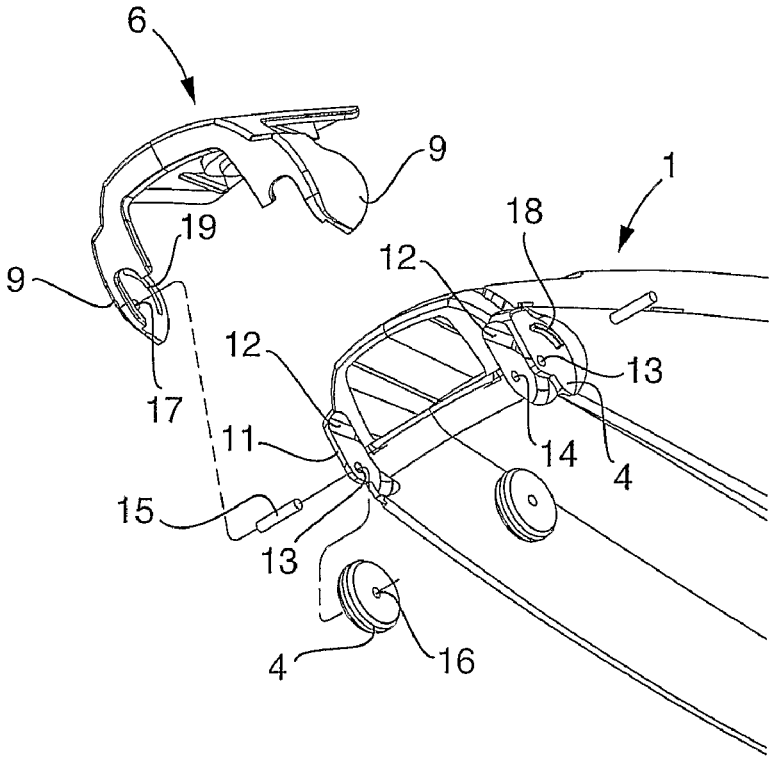
FIG. 7 is a perspective view according to FIG. 6 viewed from below.

FIGS. 6 and 7 show, in more detail, the specific design of the exemplary combined rotating/pivoting axis according to this embodiment, and the connection of the wheels and the lid to the housing. In the housing is formed a mounting wall 11, which defines a space 12, between the mounting wall and the housing, in which a wheel 4 can be accommodated. The mounting wall 11 is provided with a through hole 13, which is in alignment with a blind hole 14 in the housing 1. When the wheel 4 is positioned in the space 12, a shaft piece 15 may be introduced through the hole 13 in the mounting wall 11, through a hole 16 in the wheel 4 and into the hole 14 in the housing. In this way the wheel 4 will be rotatably journalled on the shaft piece 15 while being restricted against axial displacement by means of the mounting wall 11 and the housing.

The length of the shaft piece is so chosen that one end of the shaft piece 15 protrudes a small distance outside of the mounting wall 11 when the other end of the shaft piece will touches the bottom of the hole 14. The two side portions 9 are, on the inside surface, provided with engagement means in form of blind holes 17 which, when are installed over the ends of the shaft pieces 15 by elastically separating the side portions of the lid 6 from each other, positioning the side portions over the ends of the shaft pieces 15, and allowing the side portions to return to their undeformed position so that the blind holes 17 engage the ends of the shaft pieces 15 and thereby pivotally hold the lid 6 on the housing.

To restrict the pivoting motion when opening the lid 6, the housing may have a stop means in form of a curved ridge 18, which engages a likewise curved groove 19 on the inside of the side portions 9 of the lid 6. For further illustration, the ridge 18 and groove 19 are shown by broken lines in FIGS. 2 and 3. By making the ridge 18 shorter than the groove 19, the pivoting motion of the lid 6 is permitted but will be restricted.

The exemplary embodiments described in the summary of the invention and detailed description provide only a handful of examples of how to practice the claimed invention. The described embodiments are not intended to limit the scope of the following claims in any way, and it will be appreciated by persons of ordinary skill in the art that many variations on the invention will be readily understood and all such variations may be practiced without departing from the scope of the claims.

We claim:

1. A handheld vacuum cleaner comprising:

a housing having an electric motor and a fan driven by the motor, a debris emptying hole for removal of debris from a debris collecting compartment inside the vacuum cleaner, a lid being pivotally hinged about a pivot axis and adapted to allow closing and opening of the debris emptying hole, a nozzle defining a nozzle opening in a forward end of the vacuum cleaner through which an air stream may be drawn for collecting debris, and at least two wheels, which are positioned adjacent the nozzle opening and are rotatable about a common rotation axis, wherein the pivot axis for the lid and the rotation axis for the wheels are located on a common axis.

2. The handheld vacuum cleaner according to claim 1, wherein the pivot axis and the rotation axis are formed by two separate shaft pieces that are collinearly aligned with each other.

3. The handheld vacuum cleaner according to claim 2, wherein the shaft pieces have outer ends that are directed outwards in opposite directions.

4. The handheld vacuum cleaner according to claim 2, wherein the wheels and the lid are separately mounted to the shaft pieces, and the wheels are mounted on the shaft pieces inwardly of the lid.

5. The handheld vacuum cleaner according to claim 4, wherein the lid has a generally U-shaped portion having two legs, and wherein each leg is mounted over a respective shaft piece, and pivotally attached on the shaft pieces by pivoting mount.

6. The handheld vacuum cleaner according to claim 2, wherein the shaft pieces are positioned more distally, as compared to the nozzle opening, from the forward end of the vacuum cleaner.

7. The handheld vacuum cleaner according to claim 2, wherein the housing spaces in which the wheels are mounted, each space being defined between a central portion of the housing and a respective mounting wall located adjacent the central portion of the housing.

8. The handheld vacuum cleaner according to claim 7, wherein the shaft pieces pass through respective hole through the mounting walls, through the respective wheel, and into respective holes in the housing, and a portion of each shaft piece protrudes outside the mounting wall to define shaft end portions onto which the lid is pivotally mounted.

9. The handheld vacuum cleaner according to claim 1, wherein the lid at least partly surrounds the nozzle opening and forms part of a rim surrounding the nozzle opening.

10. The handheld vacuum cleaner according to claim 1, wherein the wheels are at least partly covered by the lid.

11. The handheld vacuum cleaner according to claim 1, wherein the lid is pivotally opened by rotating it towards the forward end of the vacuum cleaner.

12. The handheld vacuum cleaner according to claim 1, wherein the housing and the lid are comprise stop means to limit the pivoting movement of the lid.

* * * * *